US012410816B1

(12) United States Patent
Conti et al.

(10) Patent No.: US 12,410,816 B1
(45) Date of Patent: Sep. 9, 2025

(54) BLADELESS CEILING FAN

(71) Applicant: Hunter Fan Company, Memphis, TN (US)

(72) Inventors: Michael Paul Conti, Memphis, TN (US); Douglas Troy Mason, Horn Lake, MS (US); Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 19/188,407

(22) Filed: Apr. 24, 2025

(51) Int. Cl.

| | |
|---|---|
| ***F04D 25/08*** | (2006.01) |
| ***F04D 19/00*** | (2006.01) |
| ***F04D 29/00*** | (2006.01) |
| ***F04D 29/38*** | (2006.01) |
| ***F04D 29/54*** | (2006.01) |

(52) U.S. Cl.
CPC ..... *F04D 29/542* (2013.01); *F04D 19/002* (2013.01); *F04D 25/088* (2013.01); *F04D 29/005* (2013.01); *F04D 29/384* (2013.01)

(58) Field of Classification Search
CPC .... F04D 29/542; F04D 19/002; F04D 25/088; F04D 29/005; F04D 29/384
See application file for complete search history.

(56) References Cited

U.S. PATENT DOCUMENTS

| | | | | |
|---|---|---|---|---|
| 9,719,525 | B2 * | 8/2017 | Cunnane | F04D 29/441 |
| 10,487,852 | B2 * | 11/2019 | Avedon | F04D 29/601 |
| 11,022,127 | B2 | 6/2021 | Hiner | |
| 11,480,193 | B2 | 10/2022 | Whitmire | |
| 12,085,083 | B2 * | 9/2024 | Botkin | F04D 29/30 |
| 12,180,976 | B2 | 12/2024 | Arens | |
| 2017/0370363 | A1 | 12/2017 | Avedon | |

FOREIGN PATENT DOCUMENTS

| | | | |
|---|---|---|---|
| CN | 212615465 | U | 2/2021 |
| CN | 217152342 | U | 8/2022 |
| CN | 220622218 | U | 3/2024 |
| TW | I509159 | B | 11/2015 |
| WO | 2023272915 | A1 | 1/2023 |

OTHER PUBLICATIONS

Exhale Fans, "Bladeless Ceiling Fans", https://exhalefans.com/product/bladeless-ceiling-fans/ Feb. 14, 2025.

(Continued)

*Primary Examiner* — Sabbir Hasan

(74) *Attorney, Agent, or Firm* — McGarry Bair PC

(57) ABSTRACT

A ceiling fan comprising a stationary inner housing defining a first interior, a stationary outer housing that circumscribes at least a portion of the stationary inner housing and defines a second interior, a motor assembly located within the first interior and having a rotor, and a plurality of blades extending between corresponding roots and tips, with the roots coupled to the rotor and the tips extending toward to the outer housing. The tips are coupled to a tip housing that can at least partially be received within a portion of the outer housing. A flow channel is formed between the stationary inner housing and the stationary outer housing.

19 Claims, 4 Drawing Sheets

(56) References Cited

OTHER PUBLICATIONS

Home Depot, "19.7 LED Indoor Black Bladeless Low Profile Ceiling Fan Flush Mount Smart App Remote Control Dimmable Lighting",, https://www.homedepot.com/p/Lasaideal-19-7-in-LED-Indoor-Black-Bladeless-Low-Profile-Ceiling-Fan-Flush-Mount-Smart-App-Remote-Control-Dimmable-Lighting-HDL1340C789BK/331816277?emt_ppr_vfpd Feb. 14, 2025.

Target, "Bella Depot Bladeless Ceiling Fan with Light and Remote", https://www.target.com/p/bella-depot-bladeless-ceiling-fan-with-light-and-remote/-/A-1001379792#Ink=sametab Feb. 14, 2025.

* cited by examiner

BLADELESS CEILING FAN

TECHNICAL FIELD

This disclosure is directed to a ceiling fan, and more specifically, to a bladeless ceiling fan.

BACKGROUND

Ceiling fans are traditionally suspended from a structure for moving a volume of air about an area, such as a room. The ceiling fan uses a motor that drives a set of fan blades to rotate and circulate air. Rotating blades drive air, often to achieve a cooling effect, but will also vibrate and emit noise while the ceiling fan is operational.

BRIEF DESCRIPTION

In one aspect, the disclosure relates to a ceiling fan comprising a stationary inner housing defining a first interior and having a circumferential rotor channel, a stationary outer housing that circumscribes at least a portion of the stationary inner housing to define a flow channel therebetween and defines a second interior having a circumferential tip channel, a motor assembly located within the first interior and having a rotor aligned with the rotor channel, a plurality of blades extending between corresponding roots and tips with the roots coupled to the rotor, and a tip housing coupled to the blade tips and at least partially received within the tip channel.

In another aspect, the disclosure relates to a ceiling fan comprising a stationary housing defining a first interior and having a circumferential rotor channel, a motor assembly located within the first interior and having a rotor aligned with the rotor channel, a plurality of blades extending between corresponding roots and tips, with the roots coupled to the rotor; and a tip housing coupled to the blade tips.

DETAILED DESCRIPTION

Figure 1:
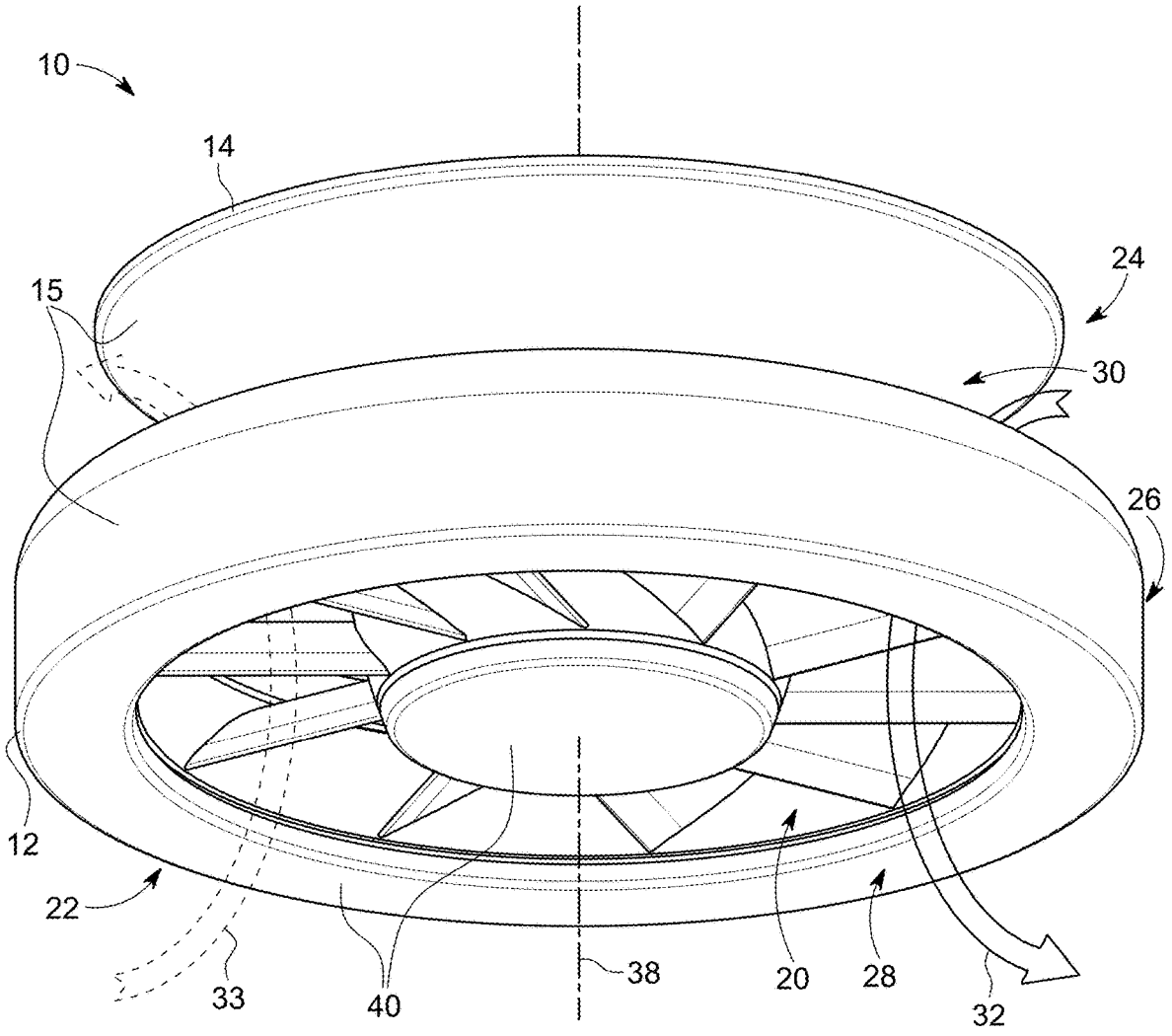
FIG. 1 is a perspective view of an exemplary bladeless ceiling fan.

The disclosure relates to a bladeless ceiling fan, a corresponding kit, along with the components forming the assembly or kit. The resulting ceiling fan can be used, for example, in residential and commercial applications. Such applications can be indoors, outdoors, or both. While this description is primarily directed toward a residential ceiling fan, it is also applicable to any environment utilizing fans or for cooling areas utilizing air movement.

Bladeless ceiling fans are a subset of ceiling fans. Bladeless fans do have blades. However, unlike normal ceiling fans, bladeless fans completely or partially hide the blades, especially the blade tips, to make the blades less visible or completely invisible to the user. To hide the blade tips, the blade tips can reside within a housing or shroud, which is typically a circumferential housing defining a non-observable volume through which the blade tips rotationally traverse. The close presence of the housing to the blade tips creates a substantial amount of aerodynamic turbulence that can increase the torque demands on the motor and/or reduce the efficiency of the air flow through the fan. A benefit of the bladeless fan as described is that it reduces the aerodynamic turbulence.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 illustrates a ceiling fan 10 in the form of a bladeless ceiling fan extending between a lower end 12 and an upper end 14, configured so the upper end 14 is adjacent a structure, such as a ceiling, when mounted. The ceiling fan 10 includes a stationary housing assembly 15, a set of blades 20, and an optional light assembly 22. The stationary housing assembly 15 includes a stationary inner housing 24 and a stationary outer housing 26 circumscribing at least a portion of the inner housing 24. Together, the inner and outer housings 24, 26 define an outlet 28, and an inlet 30 and a flow channel 32 therebetween. The flow channel 32 generally has an annular shape and extends between the lower end 12 and the upper end 14 of the ceiling fan 10. In the illustrated example, the inlet 30 of the flow channel 32 is located at the upper end 14 and can draw in air that moves through the flow channel 32 to be expelled from the outlet 28 at the lower end 12. The ceiling fan 10 can be reversible such that air is drawn in at the lower end 12 and expelled aft as illustrated by dotted arrow 33, which reverses the function of the outlet 28 and inlet 30.

The set of blades 20 can be located between the inner and outer housings 24, 26 and rotated about a rotational axis 38. In some examples, as illustrated, one or both of the inner housing 24 and the outer housing 26 can be concentric and symmetric about the rotational axis 38.

The light assembly 22 includes one or more lights 40 carried by the stationary housing assembly 15 at or adjacent to the lower end 12. The lights 40, as illustrated, are carried by the inner housing 24. However, the lights 40 could just as easily be carried by the outer housing 26 or both. The lights 40 can, in some examples, be a plurality of light emitting diodes (LEDs) that couple to a light housing (not shown) located within the first interior 34, second interior 36, or both. Other illumination sources, like traditional light bulbs may also be used instead of or in combination with the LEDs. The light assembly 22 can be supplied power by passing electricity and data lines through one or both of the inner or outer housings 24, 26. The light assembly 22 can also enclose mechanical or digital switches for turning on/off/dimming of the lights 40. In a variation where the lights 40 are not included, a cover (not shown), including an opaque cover, can be used instead of the lights 40.

Figure 2:
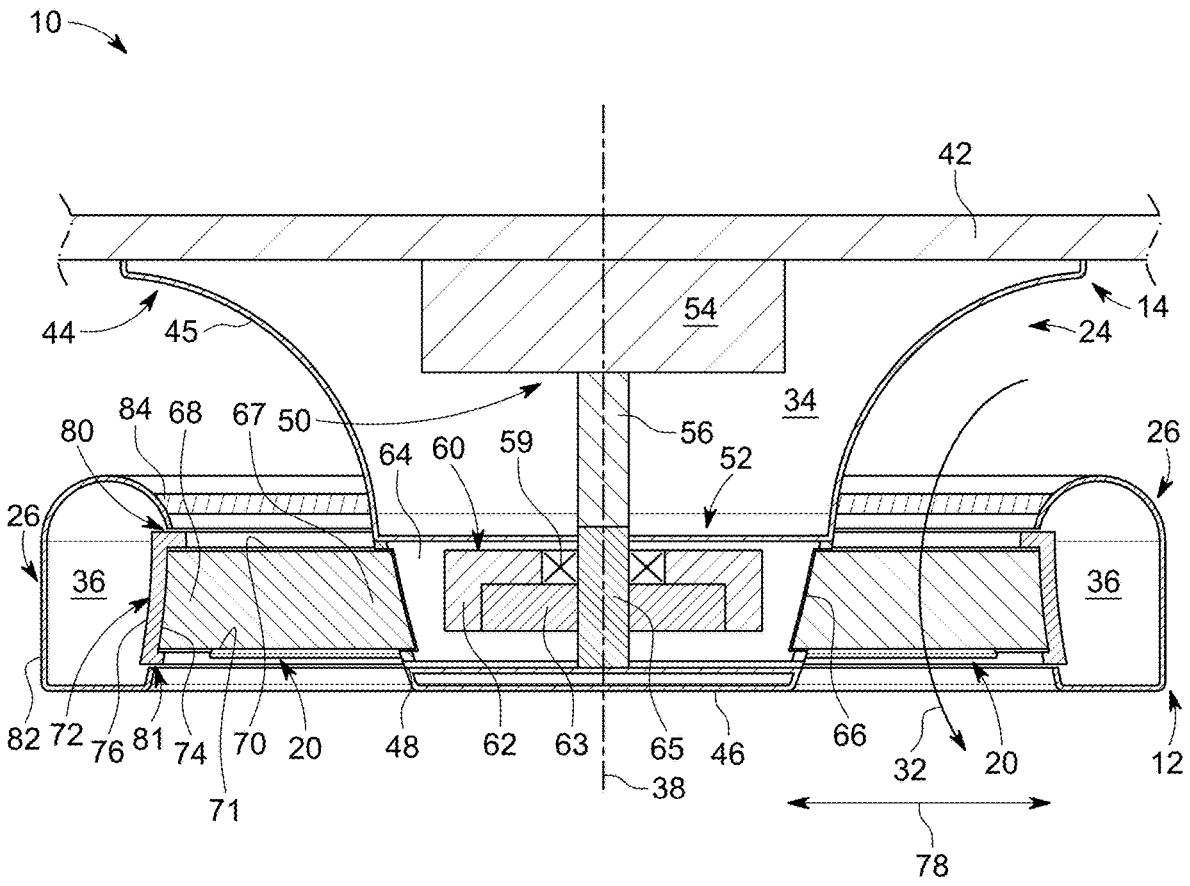
FIG. 2 is a cross-sectional view of the exemplary ceiling fan of FIG. 1 and illustrating a tip housing.

Turning to FIG. 2, a cross-sectional view of the ceiling fan 10 is shown mounted to a structure 42. It should be noted that the section seen in FIG. 2 is generally a vertically-oriented section plane, except for the blades, which are sectioned along their length, not in a vertical plane. A set of struts 84 extends between the outer housing 26 and the inner housing 24 and are configured to support and secure the outer housing 26 relative to the inner housing 24. The set of struts 84 can advantageously be vanes designed to direct the flow channel 32. The vanes can be a simple deflector, such as a louvre, or can have an airfoil cross section to further alter the airflow. In the illustrated example, the set of struts 84 are located above the set of blades 20; however, other configurations are contemplated, such as the struts 84 being located below the blades 20, or both above and below the blades. One or more of the struts 84 can be hollow or have an internal passage through which electrical power or data cables can pass, which is especially useful when the light assembly 22 is located on the outer housing 26.

The stationary inner housing 24 defines a first interior 34 that is at least partially hollow and can be used to house and visually obscure fan components used for mounting and/or fan operation. The stationary outer housing 26 defines a second interior 36, which can also be at least partially hollow and used in the same manner as the first interior. Additionally, when a light kit is mounted to the stationary outer housing 26, the second interior can be used for located the illumination sources, such as the LEDs, and/or passing the power or data cables.

The inner housing 24 defines the upper end 14 of the ceiling fan 10 that, when mounted, is disposed at or adjacent to the structure 42. The inner housing 24 extends from the upper end 14, along the rotational axis 38, to the lower end 12. The inner housing 24 has an outer radial surface or first surface 44 bounding the first interior 34.

As illustrated, the first surface 44 forms at least a portion of the flow channel 32 and can be a simple contoured surface or a more complex contoured surface. As shown, the first surface 44 is a more complex contoured surface in that it is similar to a parabola that is truncated at the lower end 12. Whether or not the first surface 44 is parabolic, it can taper such that first surface 44 is wider at the upper end 14 and narrows toward the lower end 12. A truncated cone or multiple conic sections with decreasing diameters could yield a similar shape.

The inner housing 24 comprises an upper portion 45 axially spaced from a lower portion 46 by a circumferential rotor channel 48. As such, the upper portion 45 can be the portion housing parts for mounting the fan 10 and the lower portion 46 can, for example, be the portion for housing switches or wires for the ceiling fan 10 and the light assembly 22. The rotor channel 48 can be a gap between the upper and lower portions 45, 46 that is at least partially defined by the first interior 34.

The stationary outer housing 26 is radially spaced from the stationary inner housing 24 and defines at least a portion of the flow channel 32. That is, the radial gap 78 extending between an outer radial surface or second surface 82 of the outer housing 26 and the first surface 44 of the stationary inner housing 24 can form the flow channel 32.

The outer housing 26 includes a circumferential tip channel 80 formed in the second surface 82 facing the radial gap 78 and defined by the second interior 36. The tip channel 80 can at least partially overlap axially with the rotor channel 48 with respect to the rotational axis 38. However, the axial overlap, if any, is a function of the blade shape.

The second surface 82, as illustrated, can be a contoured second surface comprising rounded outer radial surfaces, where the outer housing 26 can have a toroidal shape. As such, the contoured second surface 82 forms at least a portion of the flow channel 32. The tip channel 80 can be located within the contoured second surface 82 and the outer surface 76 of the tip housing 72 can be shaped to follow a contour of the contoured second surface 82.

The ceiling fan 10 can include a mounting assembly 50 for mounting to the structure 42 and a motor assembly 52. The structure 42 can be a ceiling, for example, from which the ceiling fan 10 suspends. It should be understood that the structure 42 is schematically shown by way of example only and can include any suitable building, structure, home, business, or other environment wherein moving air with a ceiling fan is suitable or desirable.

The mounting assembly 50 is schematically shown and can, for example, include a mounting bracket 54 and a downrod 56, such that the mounting bracket 54 is the primary coupling with the structure 42. The downrod 56, at one end, couples to the mounting bracket 54 and, at the other end, couples to the motor assembly 52.

The motor assembly 52 includes a motor 60 comprising a rotor 62 and a stator 63, which can be partially or fully enclosed by a motor housing 64. A non-rotating motor shaft 65 extends within the motor housing 64 to support the stator 63 and passes through the upper portion 45 of the inner housing 24 to connect to the downrod 56. The motor shaft 65 also extends beyond the rotor 62 and stator 63 to couple together the upper and lower portions 45, 46 of the inner housing 24. Thus, the motor shaft functions as both the structure about which the rotor 62 rotates and the structure connecting the upper and lower portions 45, 46 of the inner housing 24. In this way, the upper and lower portions 45, 46 of the inner housing can be spaced from each other to form the rotor channel 48.

The motor 60 is an external rotor motor, where at least a portion of the rotor 62 circumscribes or is radially exterior of the stator 63, and the stator 63 is non-rotationally affixed to the motor shaft 65. The rotor 62 is rotationally coupled to the non-rotating motor shaft 65, such as by the use of one or more bearing assemblies 59.

The motor housing 64 and rotor 62 are arranged and coupled such that at least a portion of the motor housing 64 can rotate about the non-rotating motor shaft 65. For example, the motor housing 64 can have a seat in which the rotor sits and is operationally secured to the motor housing. In such a configuration, the motor housing 64 could be molded plastic or formed metal that defines a seat in which the rotor is pressed-fitted or mechanically attached.

The rotatable motor housing 64 sits within the circumferential rotor channel 48, forming an outer shell for the motor assembly 52 between the upper and lower portions 45, 46. Advantageously, the motor housing is shaped such that its exterior appears as a continuation of the first surface 44. The rotatable motor housing 64 includes blade hubs 66 for coupling the set of blades 20 to the motor assembly 52. The blade hubs can be any suitable type of blade hub in the industry. An example of which includes a snap-fit connector where the root of the blade is snap-fitted into the hub. The type of blade hub and connector is not material.

The set of blades 20 include one or more blades that connect to the hubs 66 and can, together with the rotatable motor housing 64, be rotated about the rotational axis 38. The blades 20 radially extend between corresponding roots 67 and tips 68 such that the roots 67 couple to the hubs 66 and the tips 68 extend outward toward the outer housing 26.

The blades 20 have corresponding leading edges 70 and trailing edges 71 axially extending from the roots 67 to the tips 68 with respect to the rotational axis 38. A tip housing 72 can extend circumferentially about the axis 38 and couple, operably and/or physically, together the tips 68 of the blades 20.

Figure 3:
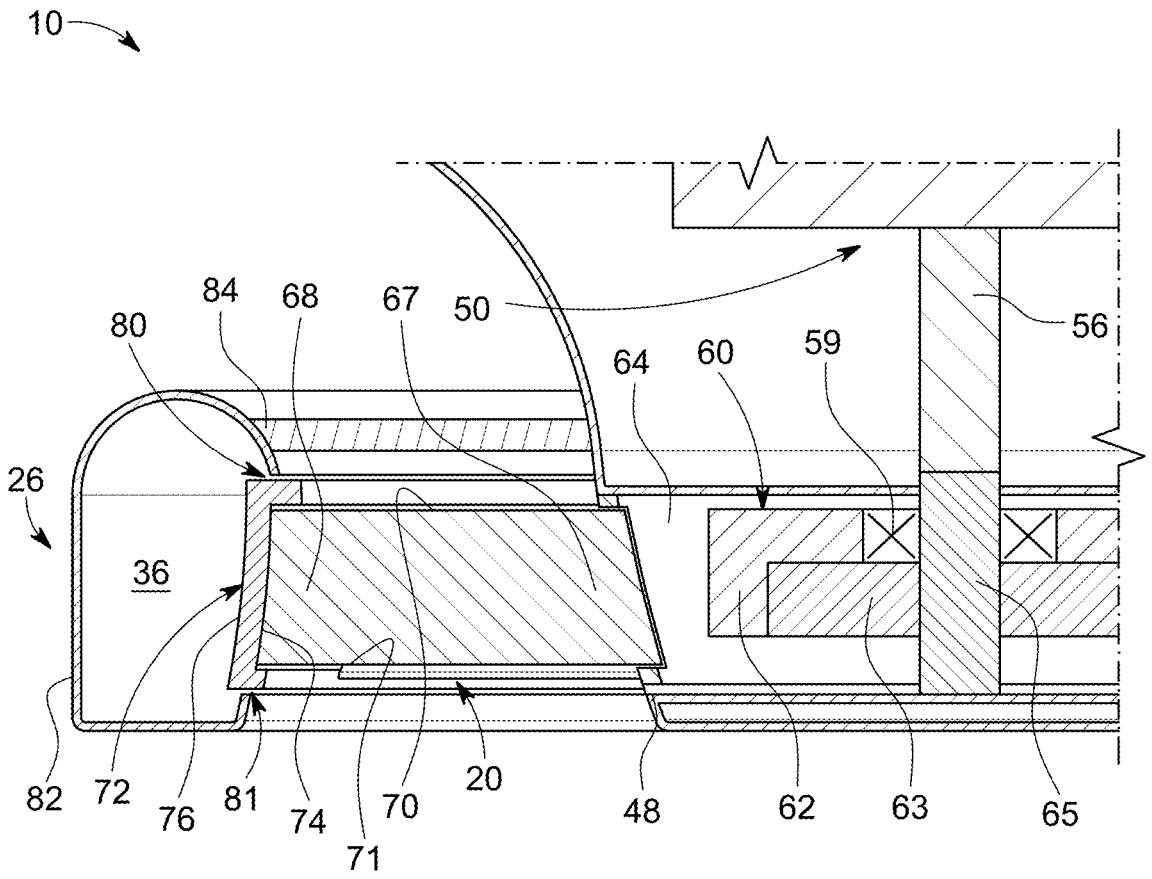
FIG. 3 is an enlarged view of the tip housing.

Referring to FIG. 3, a portion of FIG. 2 is enlarged such that the tip housing 72 is shown in greater detail where it can comprise, or be in the form of, a ring that circumscribes and connects the set of blades 20 at their corresponding tips 68. The tip housing 72 includes an inner surface 74 facing the inner housing 24 and an outer surface 76 facing the outer housing 26. In some examples, as illustrated, the tip housing 72 can extend fully along the blade tips 68. Additionally, or alternatively, the tip housing 72 can extend along at least a portion of the leading edge 69, the trailing edge 70, or a combination thereof. As such, the inner surface 74 of the tip housing 72 can be angled and extend toward the inner housing 24.

The blades tips 68 and tip housing 72 are arranged to align with the tip channel 80 and can at least partially receive the tip housing 72. As such, at least a portion of the tip housing 72 can be received in the second interior 36 of the outer housing 26. The tip channel 80 can be complementarily shaped and sized to receive the tip housing 72 such that the tip housing 72 substantially closes the tip channel 80, as illustrated, except for a clearance gap 81 at the upper and lower ends of the tip housing 72. The clearance gap 81 is sufficient to prevent the tip housing from rubbing against the outer housing 26 during rotation of the blades. While not shown, if desired, a low-friction, wear-resistance material could close off the clearance gap 81. Alternatively, instead of the low-friction, wear-resistance material, bristles could close off the gap.

In this configuration, the tip housing 72 effectively closes the tip channel 80, except for the gap 81. The continuous and smooth surface of the tip housing faces the air within the second interior 36, instead of the discrete blade tips. The continuous and smooth surface of the tip housing 72 interacting with the air in the second interior generates substantially less turbulence as compared to the blade tips without the tip housing. The reduction of turbulence at the interface of the tip housing 72 and the outer housing 26 improves the flow of air through the flow channel 32, which greatly improves the efficiency and effectiveness of the fan.

Another way one can think of this is that without the tip housing 72, the interface of the blade tips rotating through the tip channel 80 would create a zone of turbulence at the interface around the circumference, with greater turbulence being at the current location of the blade tips. The air flowing through the flow channel 32 would encounter this zone of turbulence and disrupt the air flow, even extending turbulence out further into the flow channel 32. This zone of turbulence is created even when the inner surface of the outer housing is closed and the blade tips are adjacent the inner surface. By wrapping the blade tips in the tip housing 72 and rotating the blade housing at least partially within the tip channel, this zone of turbulence is greatly diminished, thereby reducing resistance of air flow through the flow channel and improving the efficiency of the fan.

As currently understood, the generation of the turbulence will be described, with it not being limiting as understanding may change. The current understanding is based on the phenomenon that fluid in contact with a surface moves at the same speed as the surface. For example, in a pipe, the fluid in contact with the stationary pipe wall is stationary, even while the fluidly is flowing through the pipe, which creates a boundary layer between the wall and the fluid, with large speed gradients from the wall toward the middle of the pipe. In the context of the ceiling fan, when the set of blades 20 are rotatably driven by the motor 60, the air is pushed by the blades 20 and moved at the angular velocity of the blades 20, which increase as a function of the radial distance from the axis of rotation. Thus, the air in contact with the blade has the same angular velocity as the blade along the radial length of the blade. For example, the angular velocity and thus the speed of the air in contact with the blade increases from 32*a*, 32*b*, to 32*c*. However, the air in contact with the outer housing, which is stationary, has an angular velocity of zero, forming a boundary layer of air at the interface between the outer housing and the tip housing 72, where the angular velocity is maximum. The boundary layer would create a certain degree of turbulence.

Without the tip housing 72, the blade tips would periodically create a disruption in the boundary layer and temporarily increase the turbulence at the location of the blade tip. It is believed that the receipt of the tip housing 72 in the tip channel 80 eliminates the space between the tips 68 and the stationary outer housing 26 that would otherwise form large transient speed gradients and turbulence in the boundary layer as the blade tips pass. The tip housing 72, being continuous, presents a constant interface with the outer housing, which yields a constant boundary layer for a fixed rotational speed of the blades.

This is probably best understood by looking at one point on the outer housing 26 while the tip housing 72 rotates by as compared to discrete blade tips rotating by. In the case with the tip housing, the air speed gradient is always the same since the continuous tip housing 72 presents a continuous interface with the outer housing. However, in the case of the blade tips, without the tip housing, the interface is variable. When a blade tip is at the location, the speed gradient is at its greatest. However, the blade tip will rotate out of the location, which will now see the space or void between blade tips. The air at the blade tip is much faster than the air between the blade tips. The spot on the outer housing then sees a period increase in air speed gradient as the blade tip appears followed by a decrease in the air speed gradient as the space between the blade tips appears. This cycle repeats as the blade tips rotate past the location. This varying of the air speed gradient creates a lot of turbulence as compared to the continuous interface presented by the tip housing 72.

Figure 4:
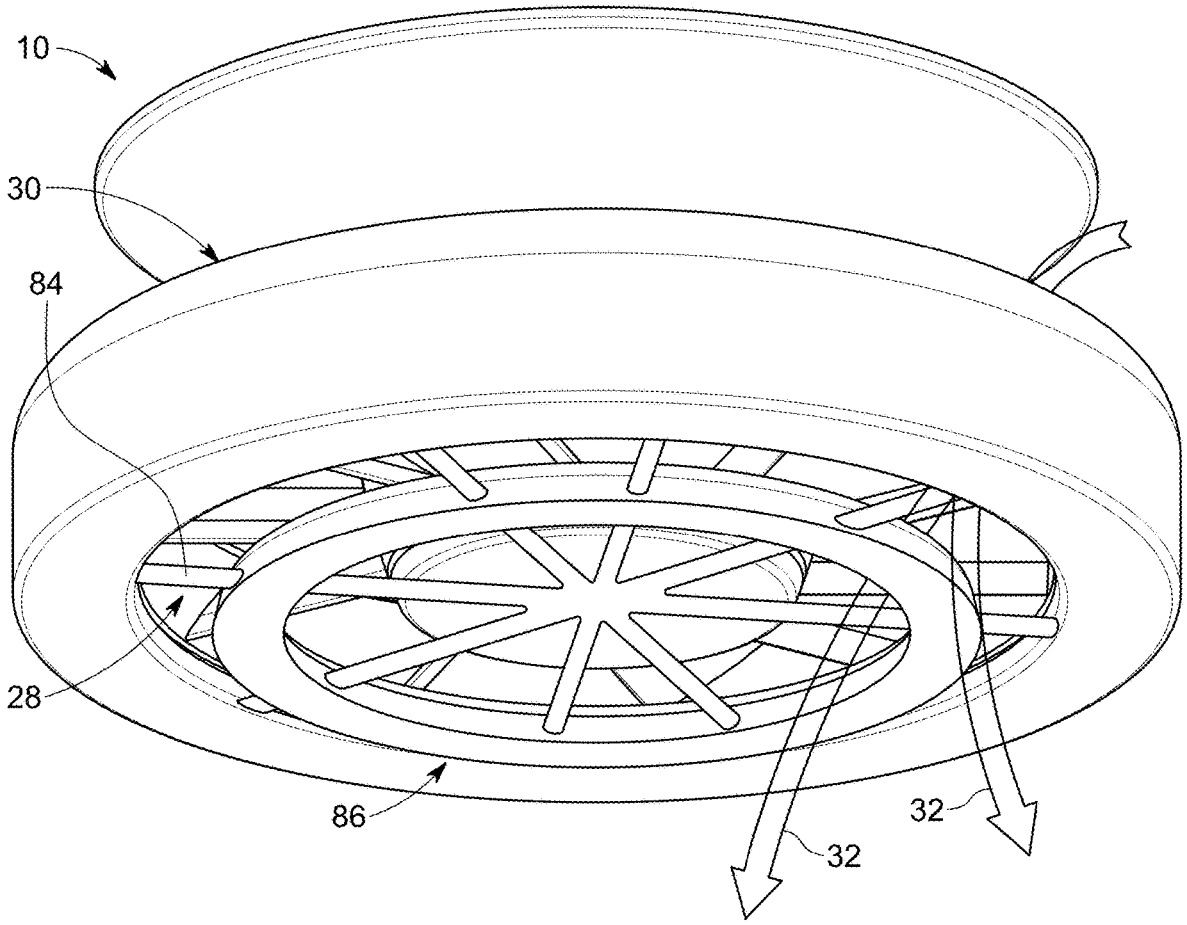
FIG. 4 is a perspective view of another exemplary ceiling fan system.

FIG. 4 illustrates the ceiling fan 10 comprising an air splitter 86 fluidly coupled to the flow channel 32. The air splitter 86 is in the form of a ring that extends circumferentially about the rotational axis 38 and is configured to interact with air moving through the flow channel 32. The air splitter 86 can be one or more air splitters 86 located at the inlet 30. In the illustrated example, the air splitter 86 is secured in place via struts 84. Alternatively, it is contemplated that the air splitter 86 be coupled to edges of the set of blades 20, for example, the trailing edges 71.

In addition to the benefits already described, enclosing blades within the inner and outer housings provide a smoother, quieter, and more efficient ceiling fan, improving consumer satisfaction. The ceiling fans as described herein provide for facilitating installation, and provide for a ceiling fan without any exposed hardware. Additionally, the tip channel provides for reduced blade sag, which can provide for improved ceiling fan lifetime and efficiency. This can further provide a quieter operation and an improved overall consumer experience.

To the extent not already described, the different features and structures of the various features can be used in combination as desired. That one feature is not illustrated in all of the aspects of the disclosure is not meant to be construed that it cannot be but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A ceiling fan comprising: a stationary inner housing defining a first interior and having a circumferential rotor channel; a stationary outer housing, circumscribing at least a portion of the stationary inner housing to define a flow channel therebetween, and defining a second interior having a circumferential tip channel; a motor assembly located within the first interior and having a rotor aligned with the rotor channel; a plurality of blades extending between corresponding roots and tips, with the roots coupled to the rotor; and a tip housing coupled to the tips of the blades and at least partially received within the tip channel.

The ceiling fan of claim any preceding clause, wherein the tip housing extends fully along the tips.

The ceiling fan of claim any preceding clause, wherein the blades have corresponding leading edges and trailing edges extending from the roots to the tips, and the tip housing extends along at least a portion of the leading edges or the trailing edges.

The ceiling fan of claim any preceding clause, wherein the tip housing extends along at least a portion of both the leading edges and trailing edges.

The ceiling fan of claim any preceding clause, wherein at least a portion of the tip housing is received in the second interior.

The ceiling fan of claim any preceding clause, wherein the stationary outer housing is radially spaced from the stationary inner housing to form a radial gap that defines the flow channel.

The ceiling fan of claim any preceding clause, wherein the rotor channel and tip channel at least partially overlap axially.

The ceiling fan of claim any preceding clause, further comprising struts coupling the stationary outer housing to the stationary inner housing.

The ceiling fan of claim any preceding clause, wherein the struts are vanes.

The ceiling fan of claim any preceding clause, wherein the stationary inner housing has a contoured first surface forming at least a portion of the flow channel.

The ceiling fan of claim any preceding clause, wherein the stationary outer housing has a contoured second surface forming at least a portion of the flow channel.

The ceiling fan of claim any preceding clause, wherein the tip channel is located within the contoured second surface.

The ceiling fan of claim any preceding clause, wherein the tip housing closes the tip channel.

The ceiling fan of claim any preceding clause, wherein the tip housing comprises an outer surface following a contour of the contoured second surface.

The ceiling fan of claim any preceding clause, wherein the tip housing closes the tip channel.

The ceiling fan of claim any preceding clause, further comprising an air splitter fluidly coupled to the flow channel.

The ceiling fan of claim any preceding clause, wherein the air splitter is located at an inlet to the flow channel.

The ceiling fan of claim any preceding clause, further comprises a light carried by at least one of the stationary outer housing or the stationary inner housing.

The ceiling fan of claim any preceding clause, wherein the light is a plurality of light emitting diodes.

A ceiling fan comprising: a stationary housing assembly defining a first interior and having a circumferential rotor channel; a motor assembly located within the first interior and having a rotor aligned with the rotor channel; a plurality of blades extending between corresponding roots and tips, with the roots coupled to the rotor; and a tip housing coupled to the blade tips.

The ceiling fan of claim any preceding clause, wherein the tip housing comprises a ring.

The ceiling fan of claim any preceding clause, wherein the ring has an inner surface facing the stationary housing and defining a flow channel therebetween.

The ceiling fan of claim any preceding clause, further comprises an air splitter fluidly coupled to the flow channel.

The ceiling fan of claim any preceding clause, wherein the air splitter is located at an inlet to the flow channel.

The ceiling fan of claim any preceding clause, further comprises a light carried by the stationary housing.

What is claimed is:

1. A ceiling fan comprising:

a stationary inner housing defining a first interior and having a circumferential rotor channel;

a stationary outer housing, circumscribing at least a portion of the stationary inner housing to define a flow channel therebetween, and defining a second interior having a circumferential tip channel;

a motor assembly located within the first interior and having a rotor aligned with the rotor channel;

a plurality of blades extending between corresponding roots and tips, with the roots coupled to the rotor; and a tip housing coupled to the tips of the blades and at least partially received within the tip channel.

2. The ceiling fan of claim 1, wherein the tip housing extends fully along the tips.

3. The ceiling fan of claim 2, wherein the blades have corresponding leading edges and trailing edges extending from the roots to the tips, and the tip housing extends along at least a portion of the leading edges or the trailing edges.

4. The ceiling fan of claim 3, wherein the tip housing extends along at least a portion of both the leading edges and trailing edges.

5. The ceiling fan of claim 1, wherein at least a portion of the tip housing is received in the second interior.

6. The ceiling fan of claim 1, wherein the stationary outer housing is radially spaced from the stationary inner housing to form a radial gap that defines the flow channel.

7. The ceiling fan of claim 6, wherein the rotor channel and tip channel at least partially overlap axially.

8. The ceiling fan of claim 7, further comprising struts coupling the stationary outer housing to the stationary inner housing.

9. The ceiling fan of claim 8, wherein the struts are vanes.

10. The ceiling fan of claim 1, wherein the stationary inner housing has a contoured first surface forming at least a portion of the flow channel.

11. The ceiling fan of claim 10, wherein the stationary outer housing has a contoured second surface forming at least a portion of the flow channel.

12. The ceiling fan of claim 11, wherein the tip channel is located within the contoured second surface.

13. The ceiling fan of claim 12, wherein the tip housing closes the tip channel.

14. The ceiling fan of claim 13, wherein the tip housing comprises an outer surface following a contour of the contoured second surface.

15. The ceiling fan of claim 1, wherein the tip housing closes the tip channel.

16. The ceiling fan of claim 1, further comprising an air splitter fluidly coupled to the flow channel.

17. The ceiling fan of claim 16, wherein the air splitter is located at an inlet to the flow channel.

18. The ceiling fan of claim 1, further comprises a light carried by at least one of the stationary outer housing or the stationary inner housing.

19. The ceiling fan of claim 18, wherein the light is a plurality of light emitting diodes.

* * * * *